US005984765A

United States Patent [19]

Hashimoto

[11] Patent Number: 5,984,765

[45] Date of Patent: Nov. 16, 1999

[54] ULTRASONIC VIBRATION COMPOSITE GRINDING TOOL

[76] Inventor: Hiroshi Hashimoto, 1117-12, Hinata, Isehara-shi, Kanagawa, Japan

[21] Appl. No.: 08/910,353

[22] Filed: Aug. 12, 1997

[30] Foreign Application Priority Data

Aug. 21, 1996 [JP] Japan ..... 8-219906

[51] Int. Cl.[6] ..... B24B 1/04

[52] U.S. Cl. ..... 451/165; 451/294; 451/262; 451/910

[58] Field of Search ..... 451/165, 548–551, 451/450, 294, 910, 262

[56] References Cited

U.S. PATENT DOCUMENTS

| | | | |
|---|---|---|---|
| 4,751,916 | 6/1988 | Bory | 451/165 |
| 5,637,037 | 6/1997 | Bergquist | 451/450 |
| 5,733,074 | 3/1998 | Stock et al. | 451/165 |

FOREIGN PATENT DOCUMENTS

| | | | |
|---|---|---|---|
| 356062755 | 5/1981 | Japan | 451/165 |
| 360191750 | 9/1985 | Japan | 451/165 |
| 8-203963 | 2/1995 | Japan . | |

*Primary Examiner*—Robert A. Rose
*Assistant Examiner*—George Nguyen
*Attorney, Agent, or Firm*—Steinberg & Raskin, P.C.

[57] ABSTRACT

An ultrasonic vibration composite grinding tool is disclosed wherein a plurality of small-sized grinding wheels are arranged for carrying out grinding of a ground material while applying vibration to the ground material, to thereby ensure stable operation of the grinding tool to accomplish efficient grinding of the ground material even when the ground material is large-sized. A grinding structure and a vibration structure are arranged. The grinding structure includes a rotatable base having a rotation axis and a plurality of grinding wheels formed into the same configuration and each including a micro-cutting surface. The grinding wheels are arranged on one surface of the base in a manner to be spaced from each other at predetermined intervals in a circumferential direction of the base about the rotation axis of the base. The vibration structure functions to vibrate the grinding wheels.

20 Claims, 16 Drawing Sheets

ULTRASONIC VIBRATION COMPOSITE GRINDING TOOL

BACKGROUND OF THE INVENTION

This invention relates to a grinding tool for grinding a material to be ground (hereinafter referred to as "ground material") represented by a hard and brittle material (hereinafter referred to as "brittle material") such as glass or ceramic, a metal material, or the like, and more particularly to an ultrasonic vibration composite grinding tool for grinding a ground material while applying vibration to the material during grinding of the material.

In order to ensure satisfactory grinding of a ground material such as a brittle material, a metal material or the like into a predetermined or desired size by infeed and permit a surface of the ground material which has been subject to grinding or processing to exhibit properties of a desired level, it is required to reduce grinding force which is applied to the ground material during the grinding, to thereby permit a grinding wheel to exhibit a satisfactory grinding performance, resulting in eliminating dressing as much as possible.

In general, when a vibrator is used to apply vibration to a grinding wheel, an increase in diameter of the grinding wheel to a degree as large as, for example, 100 mm or more renders smooth grinding substantially impossible. This causes advantages such as a reduction in grinding force and the like obtained due to the vibrator to be lost.

A substrate such as a glass substrate for a liquid crystal display device, a glass substrate for a plasma display device, a glass substrate for a thermal head, a ceramic substrate for a hybrid IC or the like tends to be increased in size with the years. Unfortunately, a grinding tool for uniformly grind a surface of the substrate at an increased speed has not been developed in the art.

SUMMARY OF THE INVENTION

In view of the foregoing disadvantage of the prior art, the inventor made both an effort and a study to develop a grinding tool capable of effectively grinding a material of a relatively increased size. As a result, it was found that the disadvantage of the prior art is eliminated by an ultrasonic vibration composite grinding tool which is so constructed that a plurality of grinding wheels formed into the same configuration and each having a micro-cutting surface are arranged on one surface of a rotatable base having a rotation axis in a manner to be spaced from each other at predetermined intervals in a circumferential direction of the base about a rotation axis of the base, to thereby provide a grinding means and a vibration means is arranged for vibrating the grinding wheels in direction of a ground material, whereby composite grinding of the ground material is carried out while applying vibration to the material and ensuring smooth feed and discharge of grinding liquid during grinding.

Accordingly, it is an object of the present invention to provide an ultrasonic vibration composite grinding tool in which a plurality of small-sized grinding wheels are arranged for grinding a ground material while applying ultrasonic vibration thereto, to thereby permit the ground material to be efficiently ground by stable operation even when the material is increased in size.

It is another object of the present invention to provide an ultrasonic vibration composite grinding tool which is capable of accomplishing grinding of a flat portion of a ground material into a predetermined or desired size by infeed and minimizing generation of a surface defect such as a crack, a pit or the like on a surface of the ground material which has been ground or processed to provide the ground surface with satisfactory surface properties (which is called in the art, grinding in a ductile mode, shear mode or malleable mode), as well as ensuring grinding of the ground material with highly increased accuracy even when it is large-sized.

It is a further object of the present invention to provide an ultrasonic vibration composite grinding tool which is capable of keeping both tangent grinding force and normal grinding force at a substantially constant level during grinding, reducing both tangent grinding force and abrasion of a micro-cutting surface to a degree sufficient to eliminate dressing, and ensuring grinding of a ground material into a predetermined or desired size by infeed.

In accordance with the present invention, an ultrasonic vibration composite grinding tool is provided. The grinding tool includes a grinding means including a base arranged in a rotatable manner and a plurality of grinding wheels, wherein the base has a rotation axis and is arranged so as to be rotatable about the rotation axis, the grinding wheels each include a micro-cutting surface and are formed into an identical configuration, and the grinding wheels are arranged on one surface of the base in a manner to be spaced from each other at predetermined intervals about the rotation axis of the base in a circumferential direction of the base. The grinding tool also includes a vibration means for vibrating the grinding wheels in directions of a ground material, whereby the ground material is subject to composite grinding while being exposed to vibration during grinding.

In a preferred embodiment of the present invention, the base is supportedly mounted on a revolving shaft and the vibration means is interposedly arranged between the grinding wheels and the base.

In a preferred embodiment of the present invention, the base is supportedly mounted on a revolving shaft and the vibration means is interposedly arranged between the grinding wheels and the base. The grinding tool further includes a first drive motor for rotatably driving the revolving shaft, a second drive motor for rotatably driving the grinding wheels, and a bearing interposedly arranged between the base and the grinding wheels.

In a preferred embodiment of the present invention, the grinding wheels each include a base member connected to the vibration means and a micro-cutting surface formed on a lower surface of the base member.

In a preferred embodiment of the present invention, the micro-cutting surface is formed by embedding an ultra-hard abrasive grain in the lower surface of the base member, wherein the ultra-hard abrasive grain has a grain size between a coarse grain size and submicrons and the ultra-hard abrasive grain is selected from the group consisting of a diamond abrasive grain and a CBN abrasive grain.

In a preferred embodiment of the present invention, the vibration means includes an ultrasonic vibrator interposedly arranged between the grinding wheels and the base to subject the grinding wheels to ultraviolet vibration in the directions of the ground material and a horn for amplifying a vibration amplitude of the ultrasonic vibrator.

In a preferred embodiment of the present invention, the revolving shaft and base are formed therein with a grinding liquid guide hole in a manner to commonly extend through a center of both revolving shaft and base, resulting in grinding liquid being fed through the grinding liquid guide hole.

In a preferred embodiment of the present invention, the micro-cutting surface of the base member of each of the grinding wheels is formed thereon with grooves in a manner to be spaced from each other at equal intervals.

In a preferred embodiment of the present invention, the micro-cutting surface is formed on only a part of the lower surface of the base member.

In a preferred embodiment of the present invention, the grinding wheels each are formed into a curved strip-like shape defined between arcs of radii different from each other about an axis of the base.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
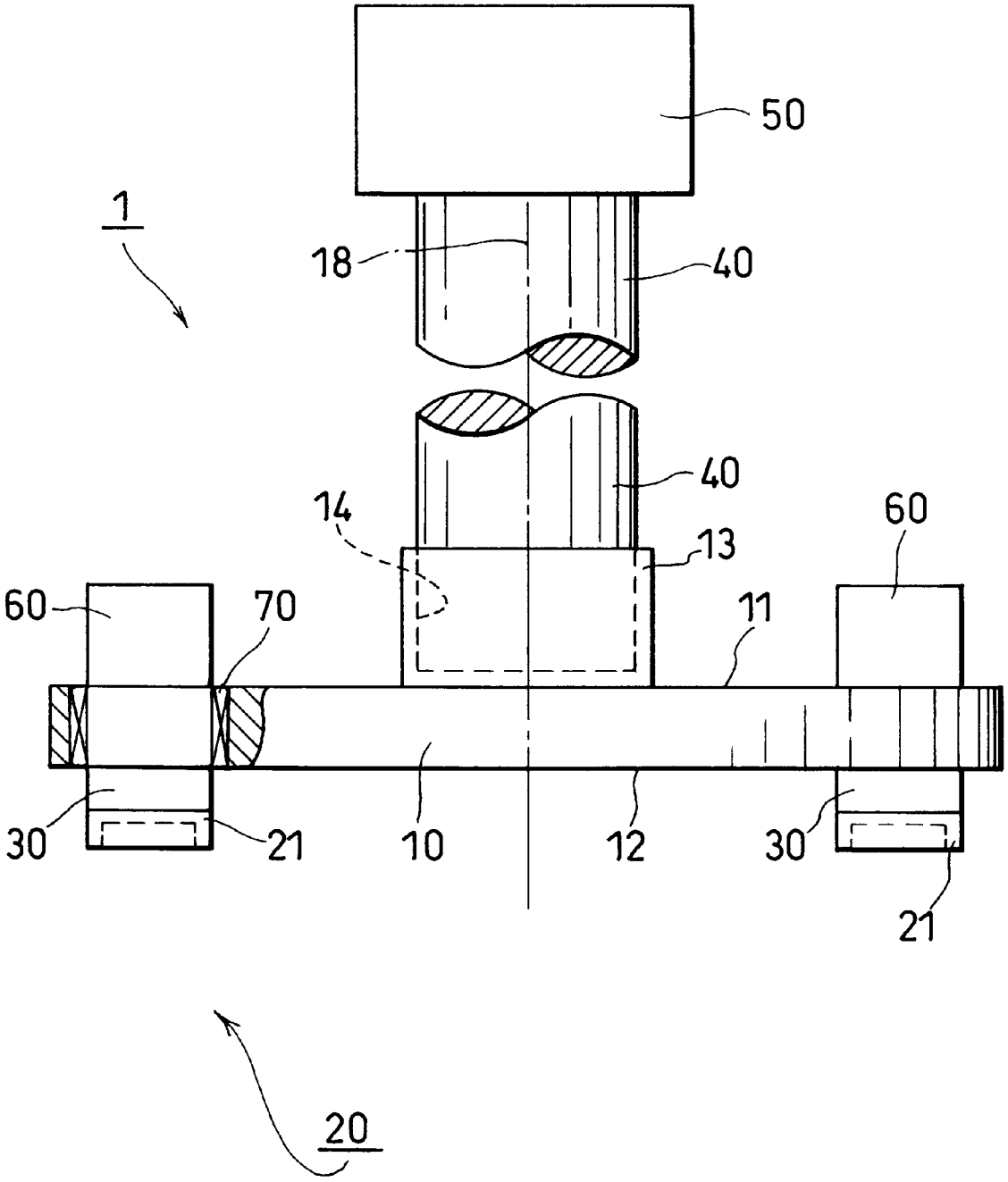
FIG. 1 is a front elevation view showing a first embodiment of an ultrasonic vibration composite grinding tool according to the present invention.

Now, an ultrasonic vibration composite grinding tool according to the present invention will be described hereinafter with reference to the accompanying drawings.

Referring first to FIGS. 1 to 8, a first embodiment of an ultrasonic vibration composite grinding tool according to the present invention is illustrated. An ultrasonic vibration composite grinding tool of the illustrated embodiment which is generally designated at reference numeral 1 is constructed so as to accomplish composite grinding of a ground material while applying vibration to the ground material during the grinding. For this purpose, the ultrasonic vibration composite grinding tool generally includes a base 10 supported on a revolving shaft 40 in a manner to be rotatable with revolution of the revolving shaft 40, a grinding means 20 constructed of a plurality of grinding wheels 21, and a vibration means 30.

The base 10 is made of a material such as a steel plate or the like which is capable of exhibiting rigidity sufficient to keep the base 10 from being deformed by grinding force. The base 10 may be formed into a disc-like shape of about 100 to 400 mm in diameter.

Figure 11:
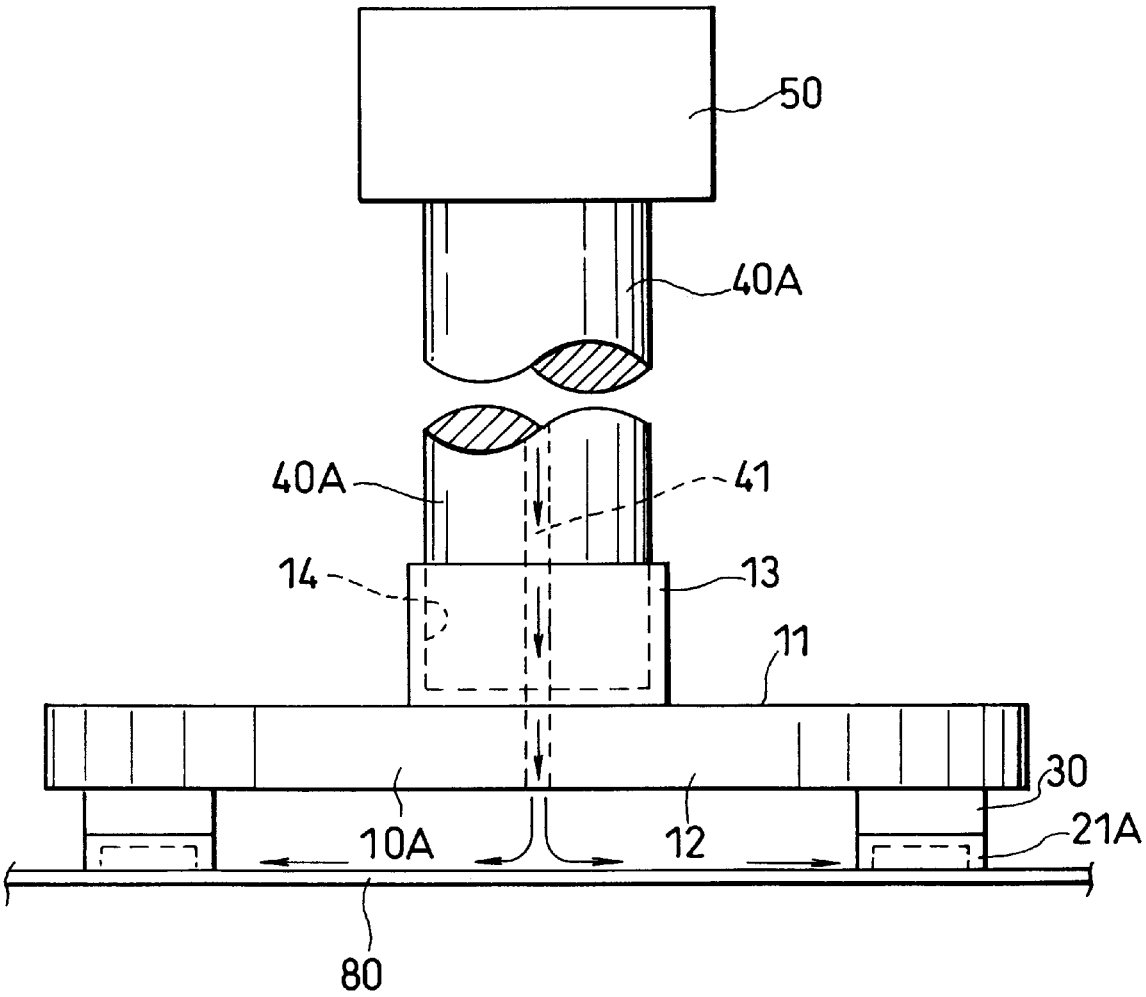
FIG. 11 is a front elevation view showing a second embodiment of an ultrasonic vibration composite grinding tool according to the present invention.

The base 10 is provided on a central portion of one surface 11 thereof which is an upper surface thereof in FIG. 11 with a connection cylinder 13 arranged so as to mount the revolving shaft 40 thereon. The connection cylinder 13 is formed on an inner peripheral surface thereof with female threads 14, which are threadedly fitted on male threads formed on an outer periphery of a proximal end portion of the revolving shaft 40 driven or revolved by a first drive motor 50.

Figure 2:
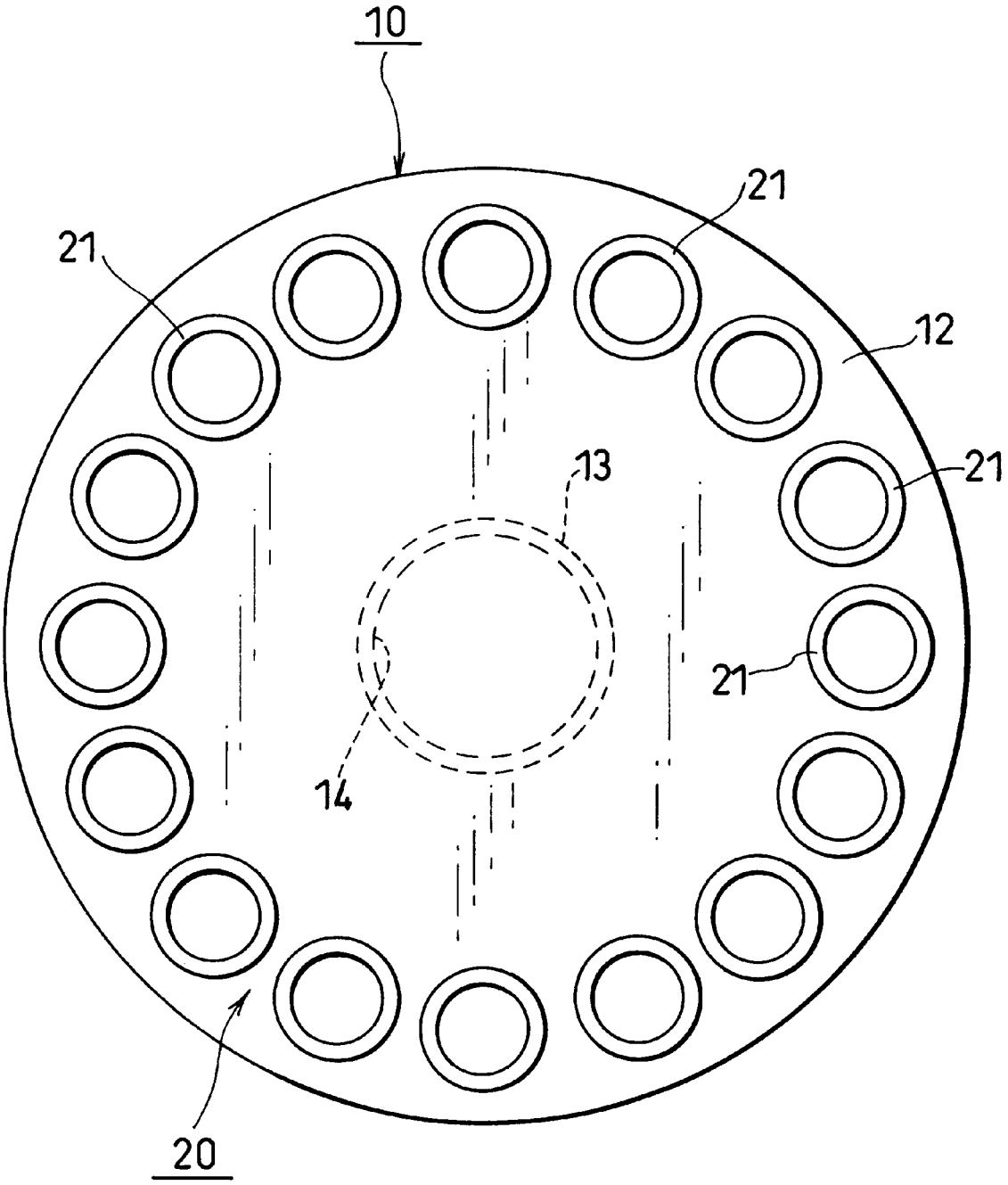
FIG. 2 is a bottom view of the ultrasonic vibration composite grinding tool shown in FIG. 1.
Figure 3:
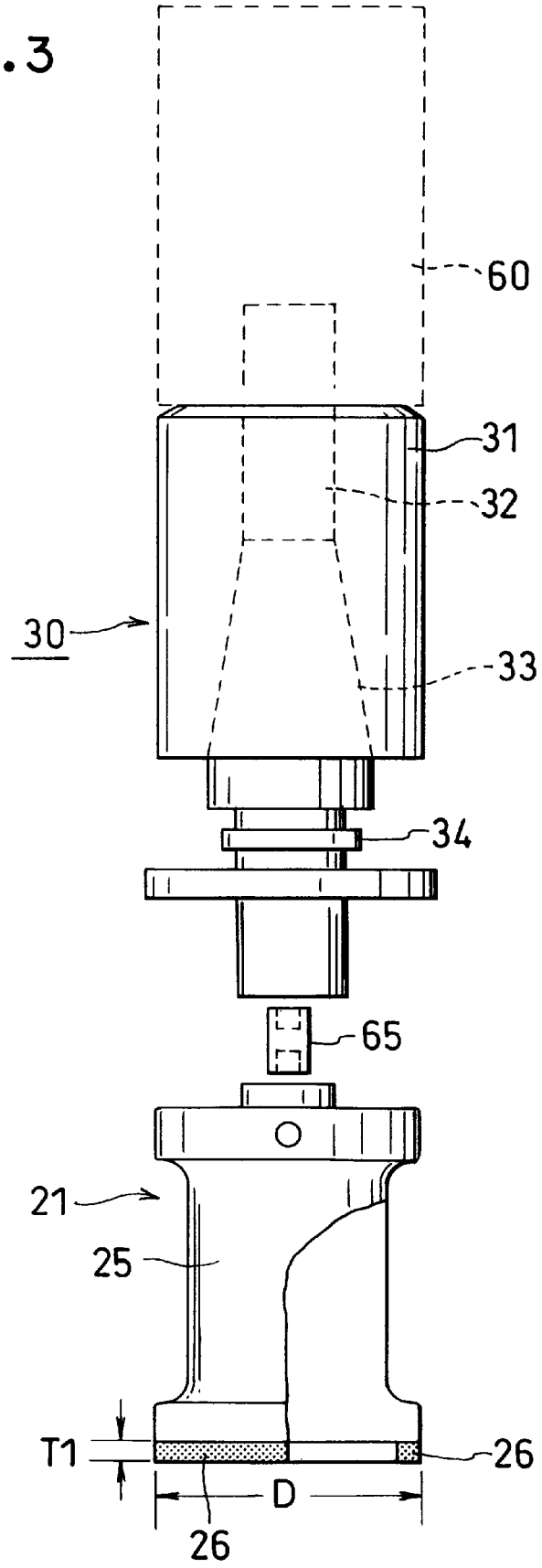
FIG. 3 is an exploded front elevation view showing a vibration means and a grinding wheel incorporated in the ultrasonic vibration composite grinding tool shown in FIG. 1.

The grinding means 20, as described above, is constructed of a plurality of the grinding wheels 21. The grinding wheels 21 are formed into the same configuration and arranged on the other surface 12 of the base 10 in a manner to be spaced from each other at predetermined intervals in a circumferential direction of the base 10 about a central axis 18 of the base 10 as shown in FIGS. 1 and 2. In the illustrated embodiment, the grinding wheels 21 are arranged on a lower surface of the base 10 as shown in FIG. 1.

The grinding wheels 21 each include a base member 25 made of a heat-resistant material and connected to the vibration means 30 by means of a set screw 65 (FIG. 3), as well as a micro-cutting surface 26 formed on a lower surface of the base member 25. The grinding wheels 21 are arranged at equal intervals on the other or lower surface 12 of the base 10.

The micro-cutting surface 26 is formed into a thickness T1 (FIG. 3) of about 1 to 3 mm by embedding an ultra-hard abrasive grain having a grain size between a coarse grain size (hundreds of microns) and submicrons in the lower surface 12 of the base member 25. The ultra-hard abrasive grains suitable for use for this purpose in the illustrated embodiment include a diamond abrasive grain, a CBN (cubic boron nitride) abrasive grain and the like. The ultra-hard abrasive grain may be fixed on the surface 12 of the base member 25 by means of a metal bond, a vitreous bond, a resin bond or the like in a manner to be slightly exposed from a surface of a layer of the bond, resulting in providing the micro-cutting surface 26.

The inventor took notice of the fact that a grain size of the ultra-hard abrasive grain above a coarse grain size (hundreds of microns) causes both a surface grain size of a surface of the ground material which has been subject to grinding and a depth of a crack layer of the ground surface to be increased to a degree sufficient to render the ground surface coarse, resulting in refinishing or re-grinding of the ground surface being required. Also, it was found that a grain size of the abrasive grain below submicrons causes grinding or processing of the ground material to be highly deteriorated in efficiency. Thus, a grain size of the ultra-hard abrasive grain is set to be between a coarse grain size and submicrons and preferably between 1 μm and 30 μm.

Figure 5:
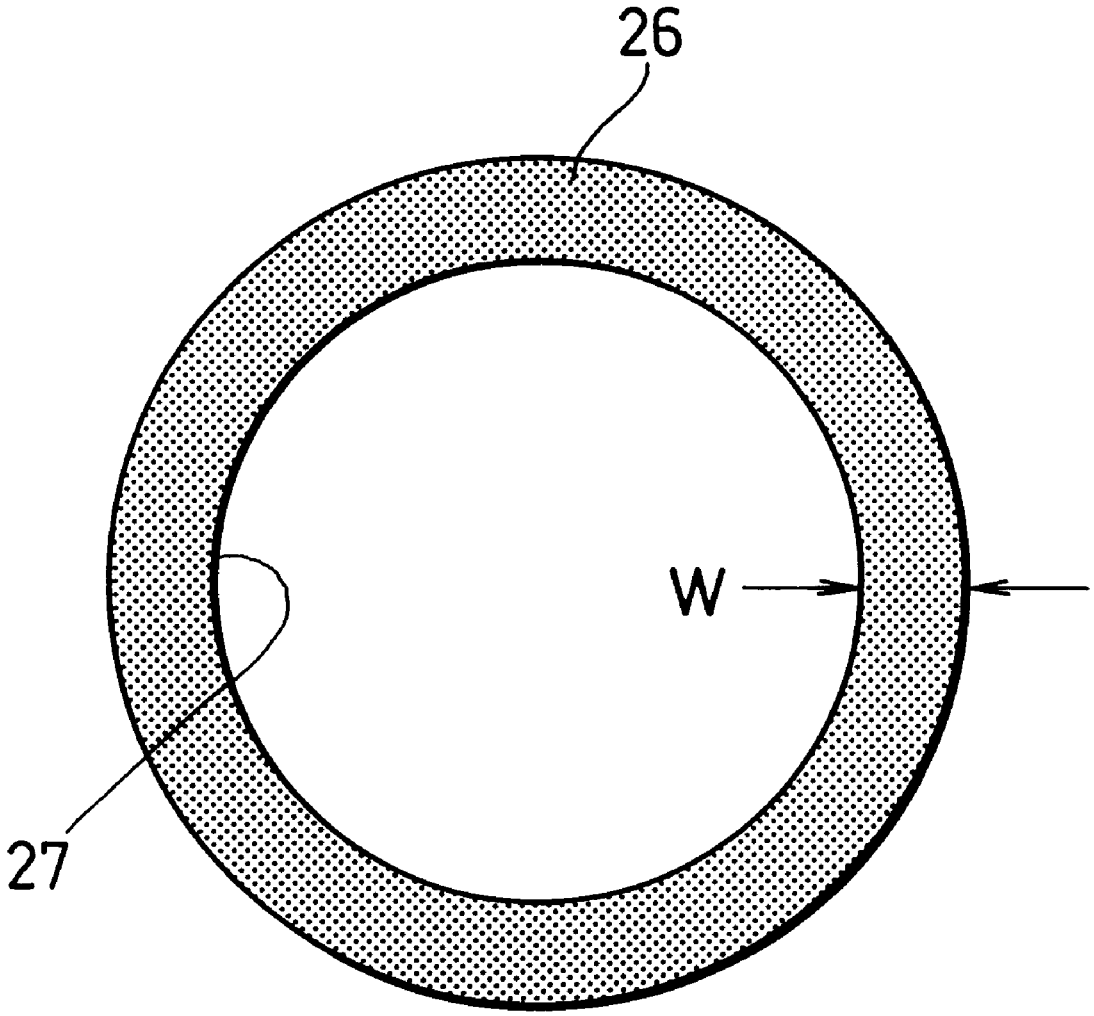
FIG. 5 is a bottom view of the grinding wheel shown in FIG. 3.
Figure 6:
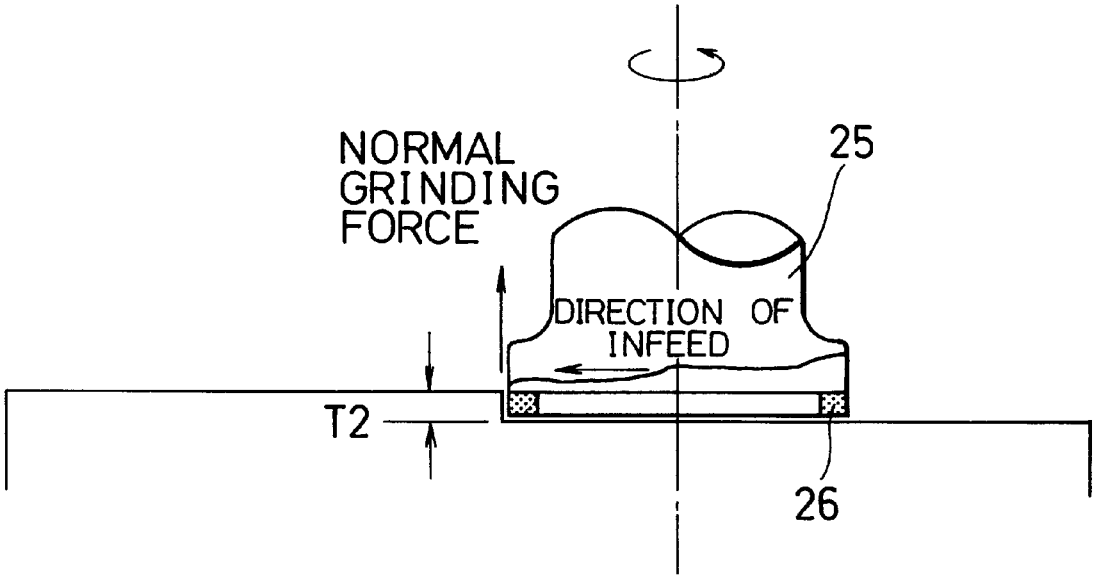
FIG. 6 is a schematic end view showing grinding of a ground material by a grinding tool.

The micro-cutting surface 26 of each of the grinding wheels 21 is formed into a wheel-like shape of a predetermined width of about 1 to 3 mm and the base member 25 is formed at a center of a bottom thereof with a recess 27 as shown in FIG. 5. Such construction permits both grinding force and the number of times of dressing to be reduced.

The vibration means 30 includes an ultrasonic vibrator 32 constructed of a piezoelectric element to subject each of the grinding wheels 21 to ultrasonic vibration in directions of the ground material arranged between the grinding wheels 21 and the base 10. Also, the vibration means 30 includes a horn 33 made of titanium and constructed so as to amplify a vibration amplitude of the ultrasonic vibrator 32. The piezoelectric element 32 and horn 33 are received in a spindle 31. Reference numeral 34 (FIG. 3) designates a feeder brush.

Figure 4:
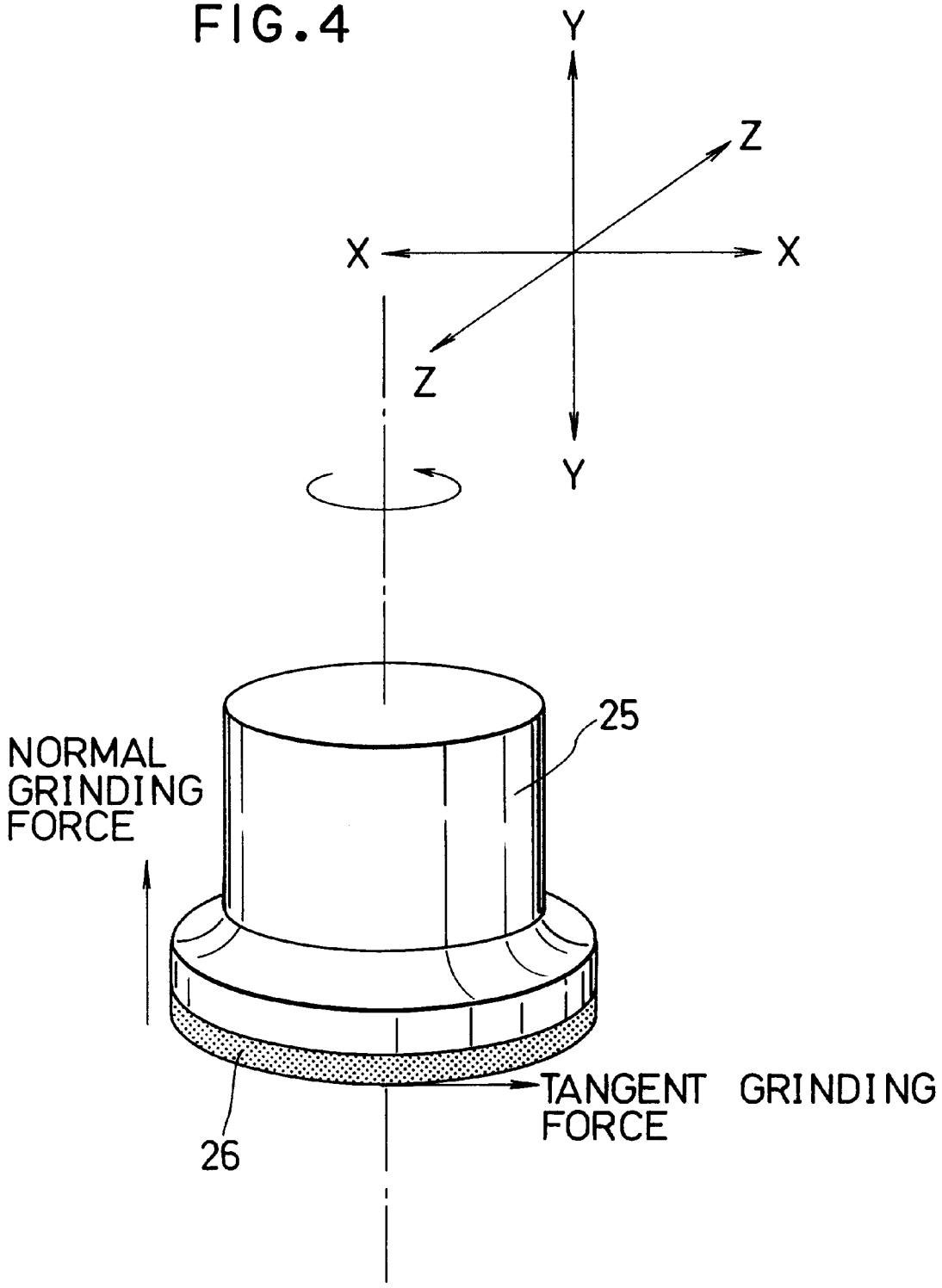
FIG. 4 is an expanded perspective view showing a lower half of a wheel section of the grinding wheel shown in FIG. 3.

The vibration means 30 acts to subject the grinding wheels 21 each mounted on a rotation shaft (not shown) to ultrasonic vibration in each of the directions of the ground material or each of X—X, Y—Y and Z—Z directions in FIG. 4. Also, the vibration means 30 acts to ensure injection or feed of grinding liquid and grind the ground material or brittle material little by little.

An increase in vibration frequency of the vibration means 30 permits the vibration means 30 to be small-sized correspondingly. However, a vibration frequency of the vibration means 30 above 100 kHz fails to permit a current technical level in the art to accomplish satisfactory small-sizing of the vibration means 30. Also, the vibration frequency below 20 kHz leads to any noise because it falls within an audible zone or band. Thus, a vibration frequency of the vibration means 30 may be suitably set to be within a range between 20 kHz and 100 kHz.

The revolving shaft 40 is driven by the first drive motor 50 and the grinding wheels 21 each are driven by a second drive motor 60. Between the base 10 and the grinding wheels 21 is interposedly arranged a bearing 70 as shown in FIG. 1.

Thus, driving of the base 10 and grinding wheels 21 independent from each other permits both rotation of each of the grinding wheels 21 on an axis thereof and revolution of the grinding wheels 21 around the base 10 to be carried out.

The base 10 and grinding wheels 21 may be rotated either in the same direction or in directions different from or opposite to each other. The base 10 may be rotated at a rotational speed up to about 10,000 rpm and the grinding wheels each may be rotated at a rotational speed between 50 rpm and 5000 rpm.

Figure 7:
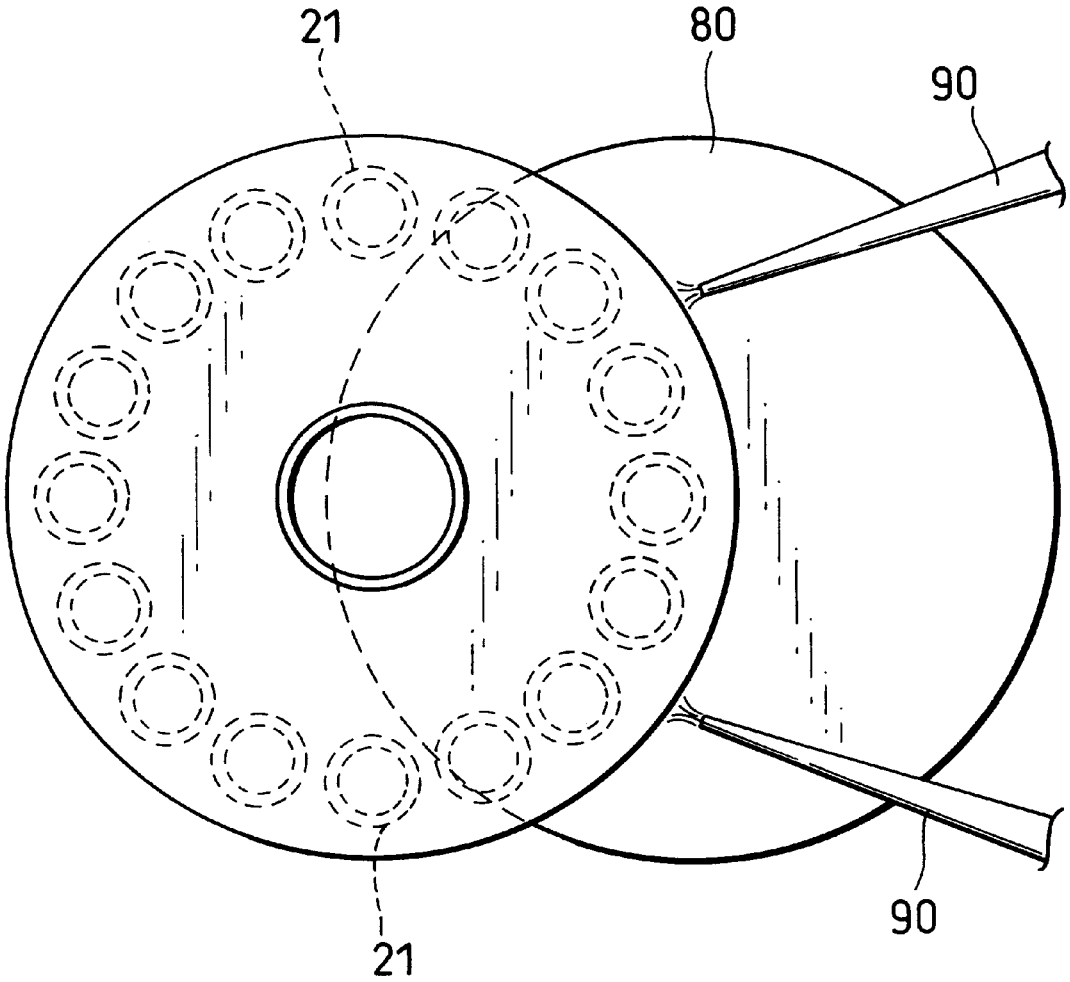
FIG. 7 is a schematic plan view showing grinding of a silicon substrate by a plurality of the grinding wheels shown in FIG. 3 while feeding grinding liquid from nozzles.

Now, grinding of a ground material by the ultrasonic vibration composite grinding tool 1 of the illustrated embodiment thus constructed will be described with reference to FIGS. 7 to 10, wherein the ground material is illustrated as a substrate 80 in FIGS. 7 and 8.

The grinding may be satisfactorily carried out by injecting grinding liquid into the ultrasonic vibration composite grinding tool through nozzles 90 while keeping a middle point (W/2) of the micro-cutting surface 26 of a predetermined width constantly abutted against a middle point P (FIG. 8) of the substrate 80. Thus, composite grinding of the ground material is carried out while subjecting it to ultrasonic vibration during infeed grinding thereof.

The inventor made a grinding test using a single grinding wheel constructed in accordance with the illustrated embodiment, wherein a silicon substrate was used as the ground material. The grinding wheel was so constructed that the bottom surface of the base member 25 has a diameter D (FIG. 3) of 42 mm and the micro-cutting surface 26 has a width (FIG. 5) of 1 mm. Also, the micro-cutting surface 26 was formed of a diamond abrasive grain of #3000 (3 to 5 μm) in grain size. In the test, both ultrasonic vibration composite grinding and grinding without ultrasonic vibration or ultrasonic vibration-free grinding were executed. In the ultrasonic vibration composite grinding, a vibration frequency of ultrasonic vibration and a vibration amplitude thereof were set to be 40 kHz and 2 to 3 μm, respectively. In each of the grindings, both a variation of tangent grinding force to the number of times of infeed and a variation of normal grinding force to the number of times of infeed were measured. Each of both grindings was carried out under the conditions that a rotational speed, a feed rate and an infeed rate are set to be 2000 rpm, 100 mm/min and 1 μm/pass, respectively. The infeed rate means a rate T2 (FIG. 6) at which the micro-cutting surface 26 enters into the silicon substrate.

Figure 9:
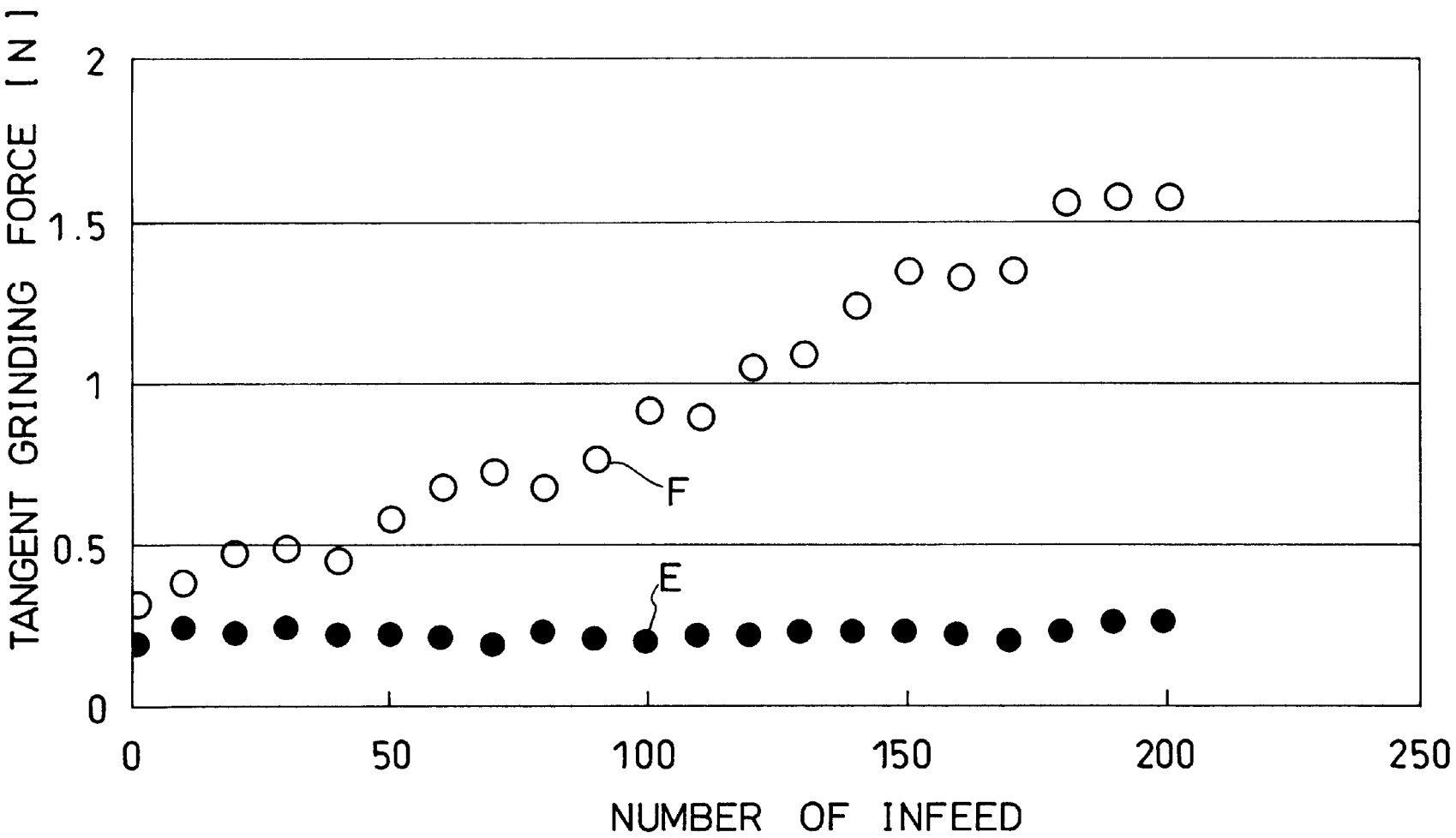
FIG. 9 is a graphical representation showing a variation of tangent grinding force to the number of times of infeed when a silicon substrate is ground by means of a single grinding wheel.
Figure 10:
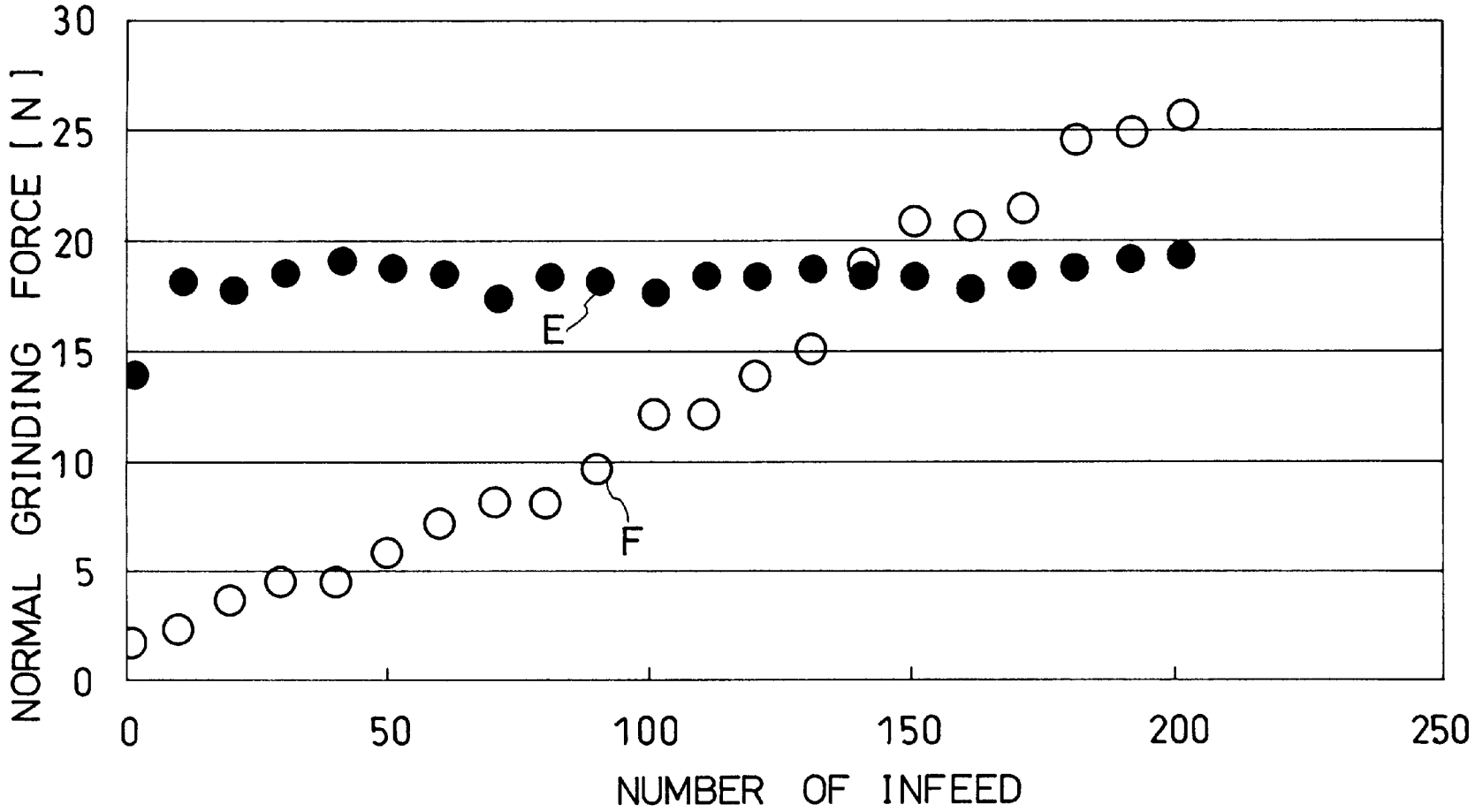
FIG. 10 is a graphical representation showing a variation of normal grinding force to the number of times of infeed when a silicon substrate is ground by means of a single grinding wheel.

The results were as shown in FIGS. 9 and 10, wherein ● indicates results of the ultrasonic vibration composite grinding and ○ indicates those of the ultrasonic vibration-free grinding.

Figure 8:
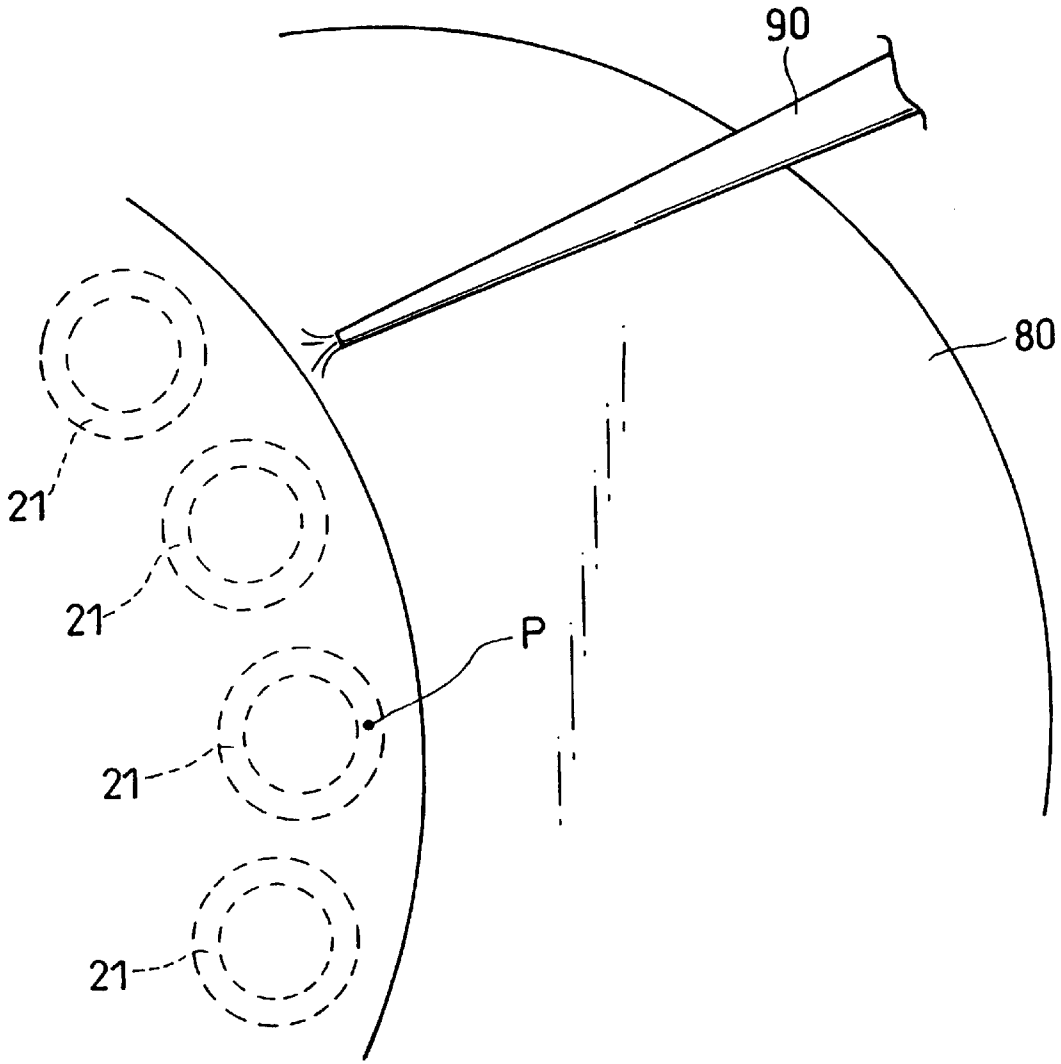
FIG. 8 is a schematic fragmentary enlarged view showing an essential part of FIG. 7.

FIGS. 8 and 9 reveal that the ultrasonic vibration composite grinding permitted both tangent grinding force and normal grinding force to be kept substantially constant as indicated at E in FIGS. 9 and 10 and minimized the tangent grinding force as indicated at E in FIG. 9. On the contrary, the ultrasonic vibration-free grinding caused both tangent grinding force and normal grinding force to be increased with an increase in the number of times of infeed as indicated at F in FIGS. 9 and 10.

Referring now to FIG. 11, a second embodiment of an ultrasonic vibration composite grinding tool according to the present invention is illustrated. The first embodiment described above is so constructed that the grinding wheels 21 revolve around the base 10 while each rotating on the axis thereof. An ultrasonic vibration composite grinding tool of the second embodiment is constructed in such a manner that grinding wheels 21A are fixed on a base 10A so as to be rotated together with the base 10A while eliminating the second drive motor 60 and bearing 70 incorporated in the first embodiment. Also, in the second embodiment, a grinding liquid guide hole 41 is formed in a revolving shaft 40A and the base 10A in a manner to commonly extend through a center of both revolving shaft 40A and base 10A, to thereby permit the revolving shaft 40A and base 10A to communicate with each other through the grinding liquid guide hole 41. Such construction permits grinding liquid to be fed through the grinding liquid guide hole 41 to the grinding wheels 21A. The remaining part of the second embodiment may be constructed in substantially the same manner as the first embodiment.

Figure 12:
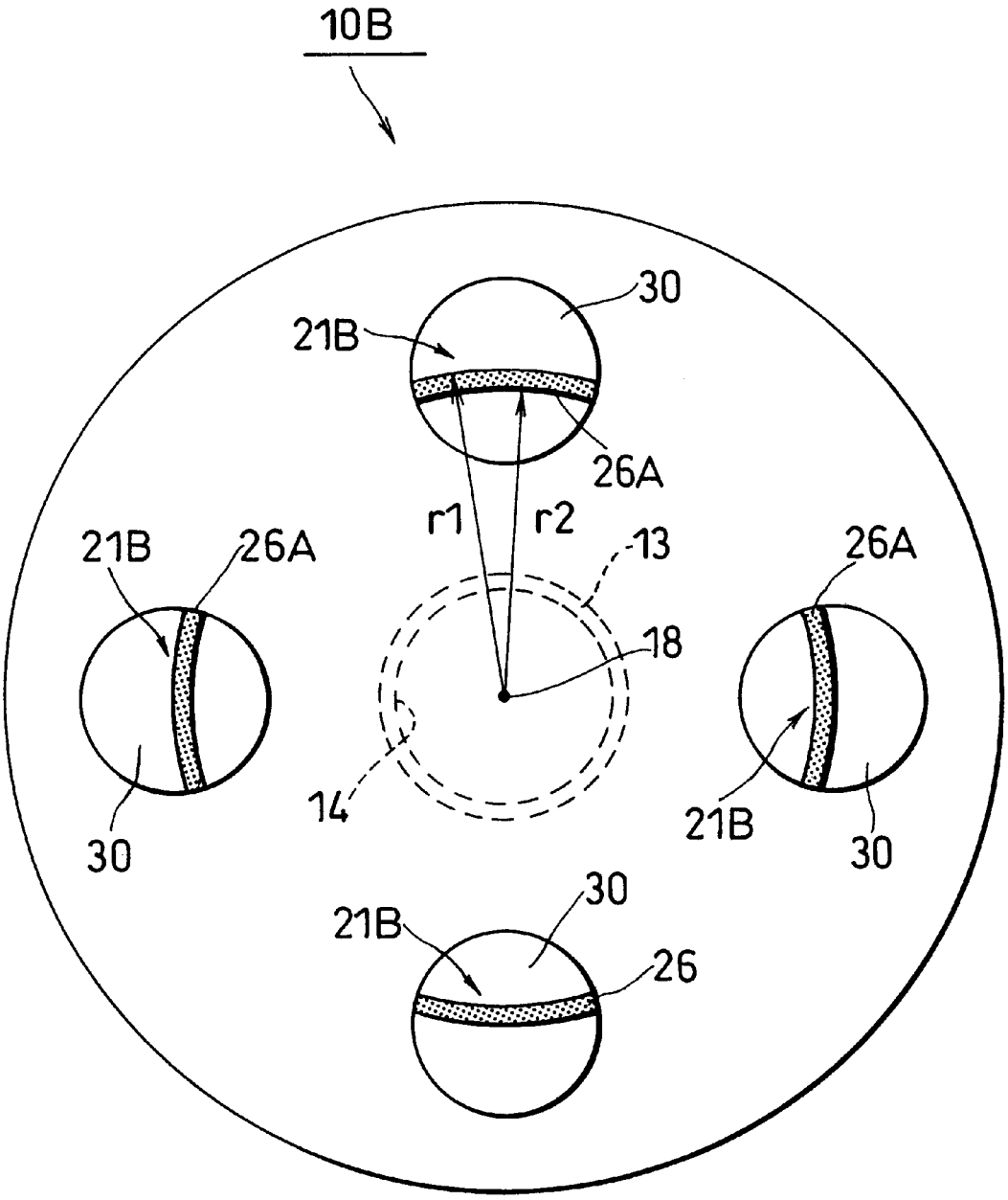
FIG. 12 is a bottom view showing a third embodiment of an ultrasonic vibration composite grinding tool according to the present invention.

Referring now to FIG. 12, a third embodiment of an ultrasonic vibration composite grinding tool according to the present invention is illustrated. An ultrasonic vibration composite grinding tool of the third embodiment is constructed in substantially the same manner as the above-described second embodiment in that grinding wheels 21B are fixed on a base 10B so as to be rotated together with the base 10B while eliminating the second drive motor 60 and bearing 70 incorporated in the first embodiment. Also, in the third embodiment, a plurality of the grinding wheels 21B each are formed into a curved strip-like shape defined between arcs of radii r1 and r2 (<r1) about an axis 18 of the rotatable base 10B. Also, four such grinding wheels 21B thus formed are arranged in a manner to be spaced at predetermined intervals from each other in a circumferential direction of the base 10*b* about the axis 18 of the base 10B.

Figure 13:
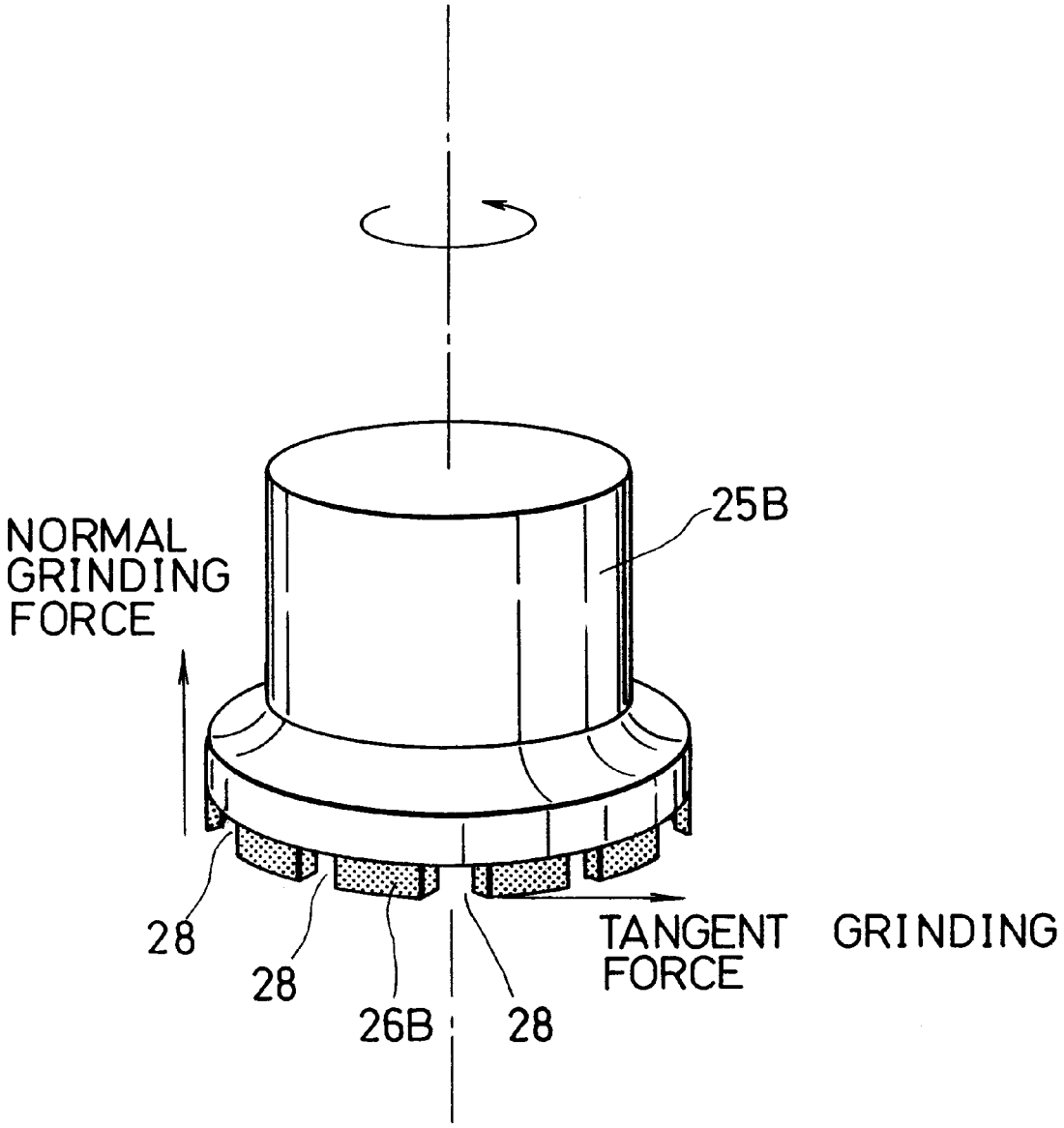
FIG. 13 is a schematic enlarged view showing an essential part of a variation of a micro-cutting surface of a grinding wheel constituting a part of an ultrasonic vibration composite grinding tool according to the present invention.
Figure 14:
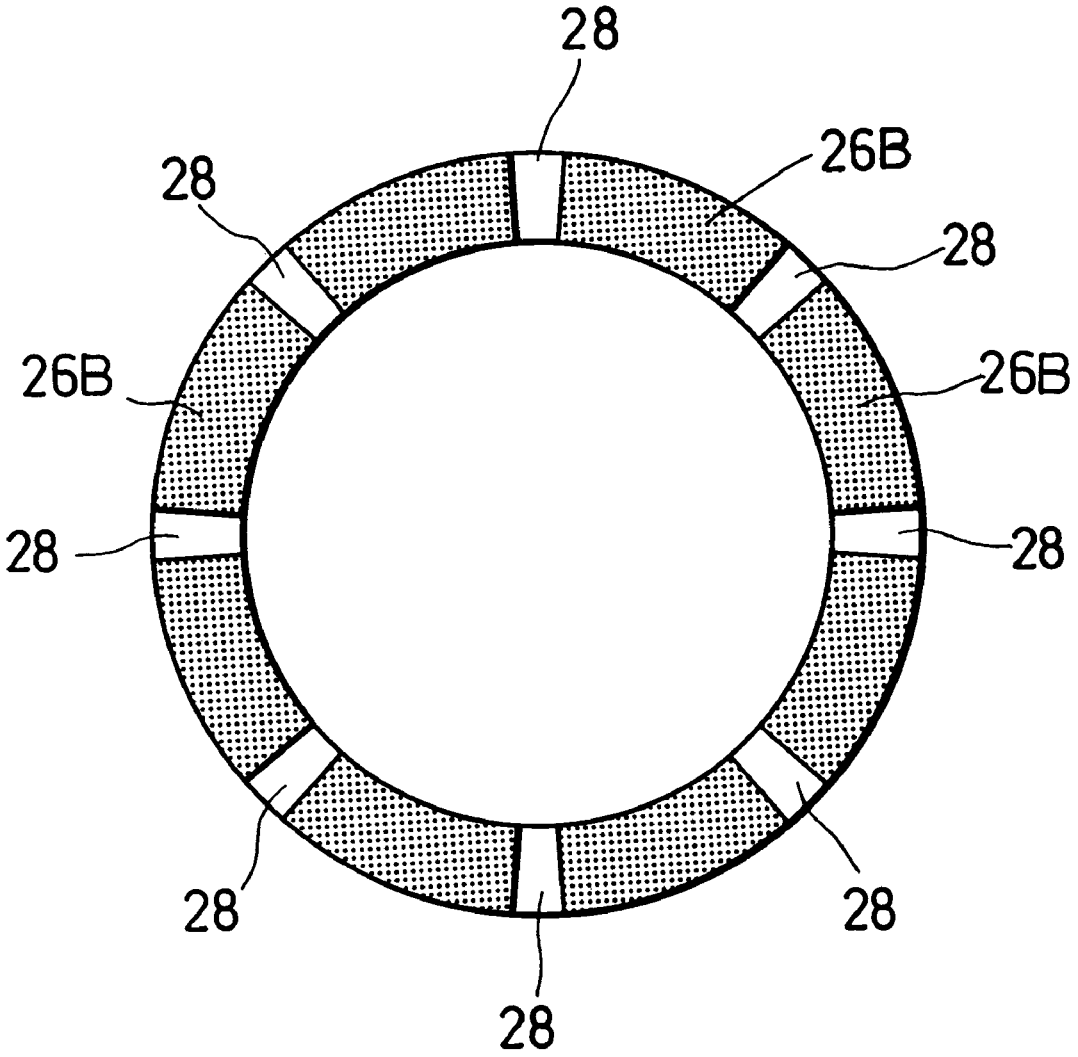
FIG. 14 is a bottom view of the grinding wheel shown in FIG. 13.

Referring now to FIGS. 13 and 14, a variation of the micro-cutting surface of each of the grinding wheels 21 of the grinding means 20 is illustrated. In the variation, a micro-cutting surface 26B of a base member 25B of a grinding wheel 21B is formed thereon with grooves 28 in a manner to be spaced from each other at equal intervals. Such construction of the variation permits both feed and discharge of grinding liquid with respect to the micro-cutting surface 26B to be more smoothly accomplished.

Figure 15:
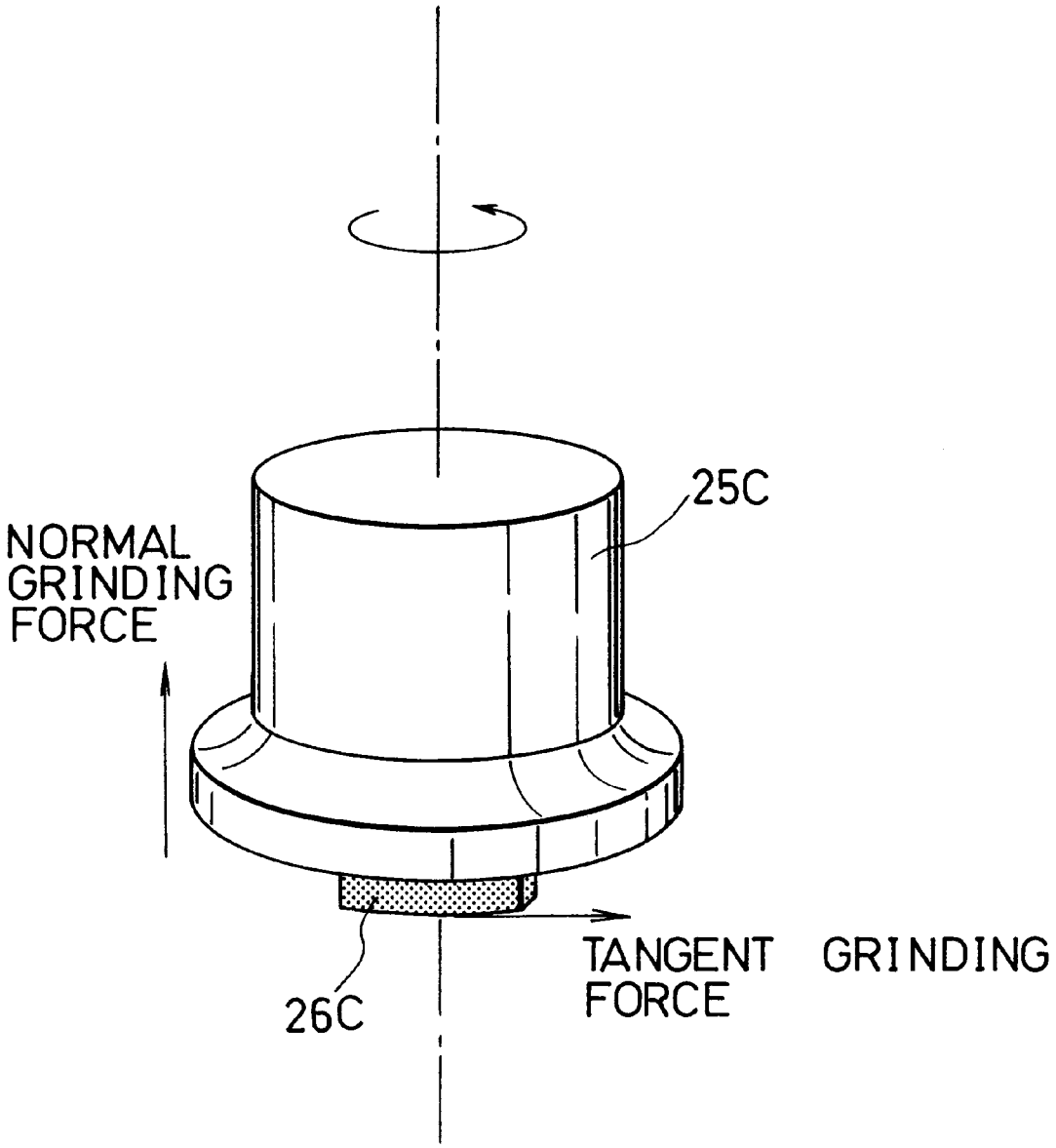
FIG. 15 is a schematic enlarged view showing an essential part of another variation of a micro-cutting surface of a grinding wheel constituting a part of an ultrasonic vibration composite grinding tool according to the present invention.
Figure 16:
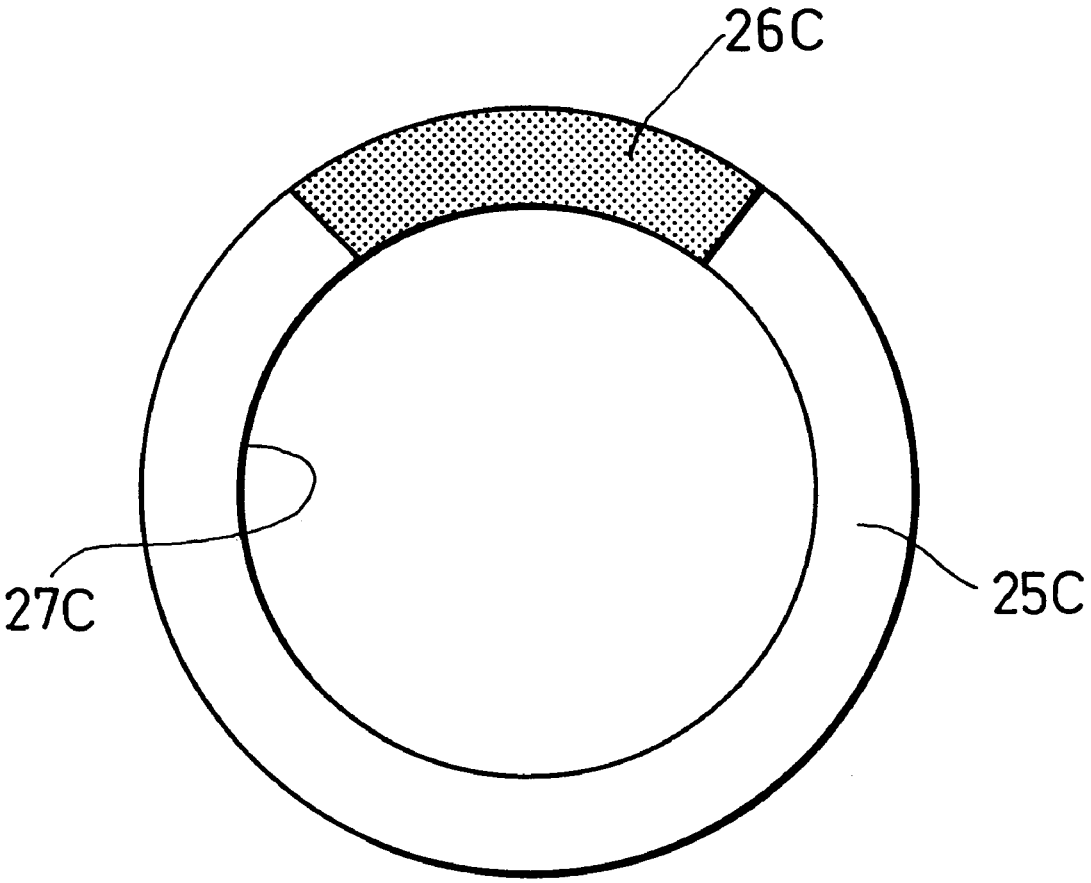
FIG. 16 is a bottom view of the grinding wheel shown in FIG. 15.

Referring now to FIGS. 15 and 16, another variation of the micro-cutting surface of each of the grinding wheels 21 of the grinding means 20 is illustrated. In the variation, a micro-cutting surface 26C is formed on only a part of a bottom or lower surface of a base member 25C. Reference character 27C designates a recess. Such construction of the variation permits tangent grinding force to be further reduced.

As can be seen from the foregoing, the ultrasonic vibration composite grinding tool of the present invention is so constructed that a plurality of the small-sized grinding wheels are arranged for carrying out grinding of a ground material while applying vibration to the ground material. Such construction ensures stable operation of the grinding means to accomplish efficient grinding of the ground material even when the ground material is large-sized.

Also, it ensures satisfactory grinding of the ground material into any predetermined or desired size by infeed and provides a surface of the ground material which has been processed or ground with satisfactory surface properties while minimizing generation of a surface defect such as a crack, a pit or the like on the surface of the ground material, so that the grinding tool may exhibit increased grinding accuracy sufficient to accomplish uniform finishing of the surface.

Further, it restrains a variation in tangent grinding force and normal grinding force, to thereby keep the forces substantially constant and minimizes tangent grinding force to a degree sufficient to reduce abrasion of the micro-cutting surface, to thereby eliminate dressing, resulting in ensuring grinding of the ground material into a desired size by infeed.

While preferred embodiments of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claimed is:

1. An ultrasonic vibration composite grinding tool for grinding in ductile mode comprising:

grinding means including a rotatable base and a plurality of grinding wheels;

said base having a vertical rotation axis and being arranged so as to be vertically rotatable about said vertical rotation axis;

said grinding wheels each including a micro-cutting surface and being formed in an identical configuration;

said grinding wheels being arranged on one surface of said base in a manner to be spaced from each other at predetermined intervals about said vertical rotation axis of said base in a circumferential direction of said base; and vibration means for vibrating said grinding wheels in a direction of a ground material;

said ground material being subject to composite grinding in the ductile mode while being exposed to vibration during grinding in the ductile mode.

2. An ultrasonic vibration composite grinding tool as defined in claim 1, wherein said base is supportedly mounted on a revolving shaft; and said vibration means is interposedly arranged between said grinding wheels and said base.

3. An ultrasonic vibration composite grinding tool as defined in claim 1, wherein said base is supportedly mounted on a revolving shaft; and said vibration means is interposedly arranged between said grinding wheels and said base;

further comprising:

a first drive motor for rotatably driving said revolving shaft;

a second drive motor for rotatably driving said grinding wheels; and a bearing interposedly arranged between said base and said grinding wheels.

4. An ultrasonic vibration composite grinding tool as defined in claim 1, wherein said grinding wheels each include a base member connected to said vibration means and said micro-cutting surface formed on a lower surface of said base member.

5. An ultrasonic vibration composite grinding tool as defined in claim 4, wherein said micro-cutting surface is formed by embedding an ultra-hard abrasive grain in said lower surface of said base member;

said ultra-hard abrasive grain having a grain size between a coarse grain size and submicrons;

said ultra-hard abrasive grain being selected from the group consisting of a diamond abrasive grain and a CBN abrasive grain.

6. An ultrasonic vibration composite grinding tool as defined in claim 4, wherein said vibration means includes an ultrasonic vibrator interposedly arranged between said grinding wheels and said base to subject said grinding wheels to ultraviolet vibration in said direction of said ground material in the ductile mode and a horn for amplifying a vibration amplitude of said ultrasonic vibrator.

7. An ultrasonic vibration composite grinding tool as defined in claim 5, wherein said vibration means includes an ultrasonic vibrator interposedly arranged between said grinding wheels and said base to subject said grinding wheels to ultraviolet vibration in said direction of said ground material in the ductile mode and a horn for amplifying a vibration amplitude of said ultrasonic vibrator.

8. An ultrasonic vibration composite grinding tool as defined in claim 2, wherein said revolving shaft and base are formed therein with a grinding liquid guide hole in a manner to commonly extend through a center of both revolving shaft and base, resulting in grinding liquid being fed through said grinding liquid guide hole.

9. An ultrasonic vibration composite grinding tool as defined in claim 4, wherein said micro-cutting surface of said base member of each of said grinding wheels is formed thereon with grooves in a manner to be spaced from each other at equal intervals.

10. An ultrasonic vibration composite grinding tool as defined in claim 5, wherein said micro-cutting surface of said base member of each of said grinding wheels is formed thereon with grooves in a manner to be spaced from each other at equal intervals.

11. An ultrasonic vibration composite grinding tool as defined in claim 4, wherein said micro-cutting surface is formed on only a part of said lower surface of said base member.

12. An ultrasonic vibration composite grinding tool as defined in claim 5, wherein said micro-cutting surface is formed on only a part of said lower surface of said base member.

13. An ultrasonic vibration composite grinding tool as defined in claim 1, wherein said grinding wheels each are formed into a curved strip-like shape defined between arcs of radii different from each other about a vertical axis of said base.

14. An ultrasonic vibration composite grinding tool in ductile mode comprising:

grinding means including a base supportedly mounted on a revolving shaft in a rotatable manner and a plurality of grinding wheels;

said base having a vertical rotation axis and being arranged so as to be vertically rotatable about said vertical rotation axis;

said grinding wheels each including a micro-cutting surface and being formed in an identical configuration;

said grinding wheels being arranged on one surface of said base in a manner to be spaced from each other at predetermined intervals about said vertical rotation axis of said base in a circumferential direction of said base; and vibration means arranged between said grinding wheels and said base for vibrating said grinding wheels in a direction of a ground material;

said ground material being subject to composite grinding in ductile mode while being exposed to vibration during grinding in the ductile mode.

15. An ultrasonic vibration composite grinding tool in the ductile mode comprising:

grinding means including a base supportedly mounted on a revolving shaft in a rotatable manner and a plurality of grinding wheels;

said base having a vertical rotation axis and being arranged so as to be vertically rotatable about said vertical rotation axis;

said grinding wheels each including a micro-cutting surface and being formed in an identical configuration;

said grinding wheels being arranged on one surface of said base in a manner to be spaced from each other at predetermined intervals about said vertical rotation axis of said base in a circumferential direction of said base;

vibration means arranged between said grinding wheels and said base for vibrating said grinding wheels in a direction of a ground material;

a first drive motor for driving said revolving shaft;

a second drive motor for driving each of said grinding wheels; and a bearing interposedly arranged between said base and said grinding wheels;

said ground material being subject to composite grinding in ductile mode while being exposed to vibration during grinding in the ductile mode.

16. An ultrasonic vibration composite grinding tool as defined in claim 4, wherein said micro-cutting surface includes an ultra-hard abrasive grain in said lower surface of said base member, said ultra-hard abrasive grain having a grain size between 1 $\mu$m and 30 $\mu$m.

17. An ultrasonic vibration composite grinding tool as defined in claim 1, wherein each of said grinding wheels is rotatable about a rotation axis, further comprising a first drive motor for rotating said base about its rotation axis, and a plurality of second drive motors, each associated with one of said grinding wheels for rotating said grinding wheel about its rotation axis, said second drive motors being separate from said first drive motor such that the direction in which said base is rotatable does not limit the direction in which said grinding wheels are rotatable.

18. An ultrasonic vibration composite grinding tool as defined in claim 1, wherein each of said grinding wheels is rotatable about a rotation axis, further comprising a first drive motor for rotating said base about its rotation axis, and a plurality of second drive motors, each associated with one of said grinding wheels for rotating said grinding wheel about its rotation axis, said second drive motors providing rotational force independent from one another.

19. An ultrasonic vibration composite grinding tool as defined in claim 14, wherein said grinding wheels each include a base member connected to said vibration means, said micro-cutting surface being formed on a lower surface of said base member, said micro-cutting surface including an ultra-hard abrasive grain in said lower surface of said base member, said ultra-hard abrasive grain having a grain size between 1 $\mu$m and 30 $\mu$m.

20. An ultrasonic vibration composite grinding tool as defined in claim 15, wherein said grinding wheels each include a base member connected to said vibration means, said micro-cutting surface being formed on a lower surface of said base member, said micro-cutting surface including an ultra-hard abrasive grain in said lower surface of said base member, said ultra-hard abrasive grain having a grain size between 1 $\mu$m and 30 $\mu$m.

* * * * *